US006918774B2

(12) United States Patent
Wu

(10) Patent No.: US 6,918,774 B2
(45) Date of Patent: Jul. 19, 2005

(54) ELECTRICAL CONNECTOR HAVING LONG CIRCUIT BOARDS

(75) Inventor: Jerry Wu, Irvine, CA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/465,314

(22) Filed: Jun. 18, 2003

(65) Prior Publication Data

US 2004/0259392 A1 Dec. 23, 2004

(51) Int. Cl.[7] ..... H01R 12/00
(52) U.S. Cl. ..... 439/65; 439/701; 439/608
(58) Field of Search ..... 439/65–75, 608–607, 439/701; 385/135

(56) References Cited

U.S. PATENT DOCUMENTS 3,605,068 A * 9/1971 Rayburn ..... 439/291
6,102,747 A 8/2000 Paagman
6,217,364 B1 4/2001 Miskin et al.
6,267,604 B1 * 7/2001 Mickievicz et al. ..... 439/79
6,540,522 B2 * 4/2003 Sipe ..... 439/61
6,623,310 B1 * 9/2003 Billman et al. ..... 439/701
6,692,305 B2 * 2/2004 Nelson et al. ..... 439/608

* cited by examiner

*Primary Examiner*—Michael C. Zarroli
(74) *Attorney, Agent, or Firm*—Wei Te Chung

(57) ABSTRACT

An electrical connector (1) includes a dielectric housing (2) including front and rear housing portions (20, 22) each defining a number of juxtaposed channels (202) therein and an intermediate housing portion (24) interconnecting the front housing portion with the rear housing portion. A number of elongate circuit boards (3) are side by side retained in the housing along a second direction perpendicular to the first direction. The circuit boards include front and rear mating edges (30, 32) respectively received in the channels of the front and the rear housing portions for mating with complementary components.

14 Claims, 7 Drawing Sheets

ELECTRICAL CONNECTOR HAVING LONG CIRCUIT BOARDS

CROSS-REFERENCE TO RELATED APPLICATIONS

Relevant subject matter is disclosed in co-pending U.S. patent application Ser. No. 10/612,114 filed on Jul. 1, 2003 and entitled "ELECTRIAL CONNECTOR", and U.S. patent application Ser. Nos. 10/278,520 filed on Oct. 22, 2002 and entitled "ELECTRICAL CABLE CONNECTOR", 10/316,547 filed on Dec. 10, 2002 and entitled "CABLE ASSEMBY" and 10/317,830 filed on Dec. 11, 2002 and entitled "CABLE ASSEMBLY", all of which are invented by the same inventor as this patent application and assigned to the same assignee with this application.

BACKGROUND OF THE INVENTION

1. Field of the Invention

The present invention relates to an electrical connector for high speed signal transmission, and particularly to an electrical connector for simultaneously engaging with two complementary connectors respectively mounted on first and second circuit substrates to establish an electrical connection therebetween.

2. Description of Related Art

With the development of communication and computer technology, high density electrical connectors are desired to construct a large number of signal transmitting paths between two electronic devices. Each of these electrical connectors provides a plurality of circuit boards to thereby achieve improved signal transmission of different electrical characteristics through the connector. Such high density electrical connectors are widely used in internal connecting systems of severs, routers and the like requiring high speed data processing and communication.

These connectors generally comprise two mating connector halves, i.e., a plug connector connecting with a first circuit substrate and a receptacle connector connecting with a second circuit substrate. An electrical connection is established between the first and the second circuit substrates through a direct engagement of the plug and the receptacle connectors. In some special circumstances where the connectors mounted on the first and the second circuit substrates are of the same type or the first and the second circuit substrates are required to have a larger distance therebetween, cable assemblies are then provided to achieve the electrical connection between the first and the second circuit substrates.

U.S. Pat. No. 6,217,364, issued to Miskin et al., discloses a cable assembly comprising a cable and an electrical connector terminated to one end of the cable. The connector includes an insulating housing formed by a pair of substantially identical housing halves and conductive terminals overmolded in a plurality of thin flat wafers to connect with a plurality of wires of the cable. The housing halves combines to define an interior cavity having a front opening and a rear opening. The wafers are closely juxtaposed in a parallel array and are positioned within the interior cavity of one of the housing halves such that the cable projects out of the rear opening of the cavity. The other housing half is then to completely enclose the cable and wafer subassembly. However, the cable and wafer subassembly are retained in the housing by securing the housing halves together through bolts and nuts, thereby complicating the assembly of the cable assembly. Furthermore, an engagement of the housing halves is easy to become loose due to vibration during the transportation and other matters, whereby the cable and the wafer subassembly cannot be stably retained in the housing.

U.S. Pat. No. 6,102,747 (the '747 patent), issued to Paagman, discloses a cable assembly comprising a cable and an electrical connector terminated to one end of the cable. Referring to FIGS. 4*a*–4*c* and 5*a*–5*c* of the '747 patent, the connector includes an insulating housing with a plurality of parallel slots defined therein and a plurality of modules received in the slots of the housing. Each module includes a circuit substrate, a receptacle carrier having a plurality of fork contacts at one end of the substrate and an insulation displacement contact (IDC) carrier at the other end of the substrate opposite the terminal carrier. The insulation displacement carrier has insulation displacement contacts connecting with conductors of corresponding cables. The modules are retained in the housing through an interference fit with the housing.

In order to electrically connect the first and the second circuit substrates, the cable assembly is required to have two connectors terminated to each end of the cable by connecting means as disclosed in the above-mentioned patents, thereby complicating the manufacture of the cable assembly. As a result, the manufacturing cost is accordingly increased.

Hence, an improved electrical connector for electrically connecting a first circuit substrate to a second circuit substrate is required to overcome the disadvantages of the related art.

SUMMARY OF THE INVENTION

Accordingly, an object of the present invention is to provide an electrical connector which can simultaneously engage with complementary connectors mounted on first and second circuit substrates to achieve an electrical connection therebetween.

In order to achieve the object set forth, an electrical connector in accordance with the present invention comprises a dielectric housing including front and rear housing portions each defining a plurality of juxtaposed channels therein and an intermediate housing portion interconnecting the front housing portion with the rear housing portion. A plurality of elongate circuit boards is side by side retained in the housing along a second direction perpendicular to the first direction. The circuit boards comprise front and rear mating edges respectively received in the channels of the front and the rear housing portions for mating with complementary components.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
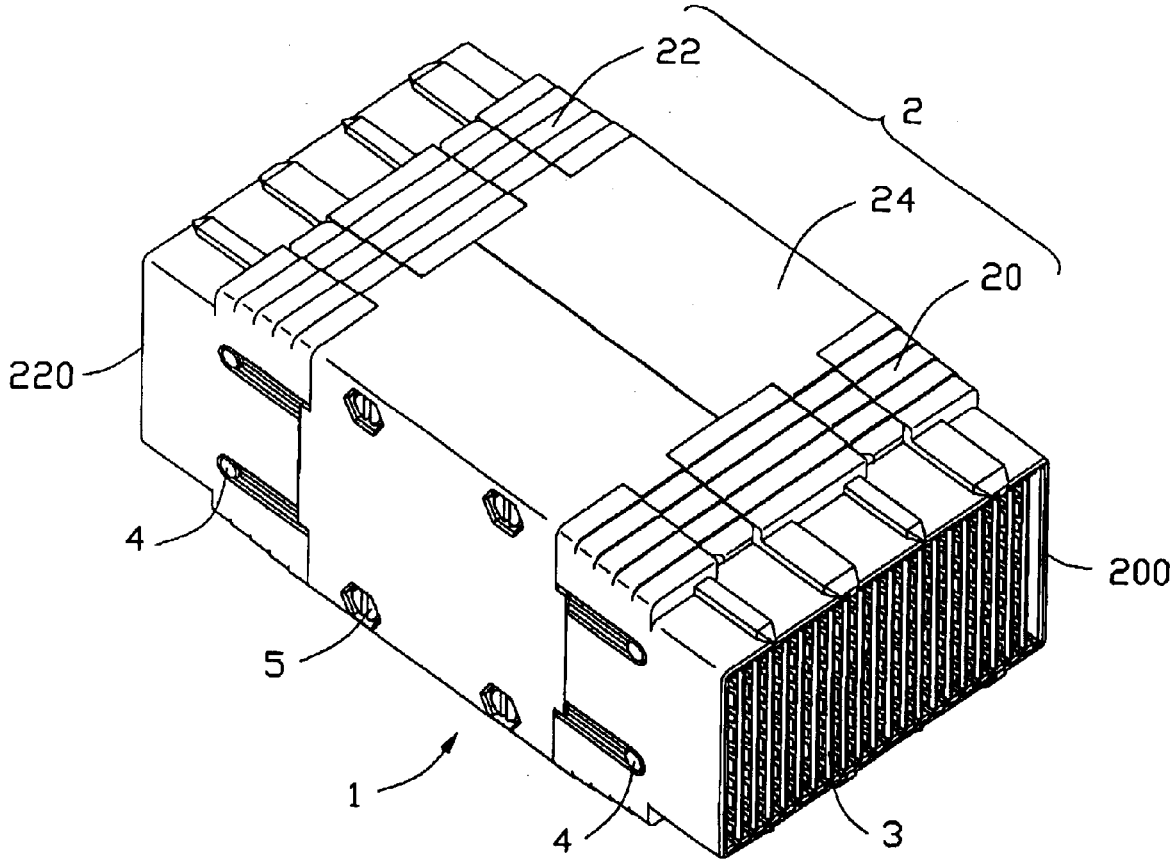
FIG. 1 is an assembled perspective view of an electrical connector in accordance with the present invention.

Referring to FIG. 1, an electrical connector 1 in accordance with the present invention comprises an elongate dielectric housing 2, a plurality of elongate circuit boards 3 received in the dielectric housing 2 and a plurality of first and second fastening elements 4,5 retaining the circuit boards 3 in the housing 2.

Figure 2:
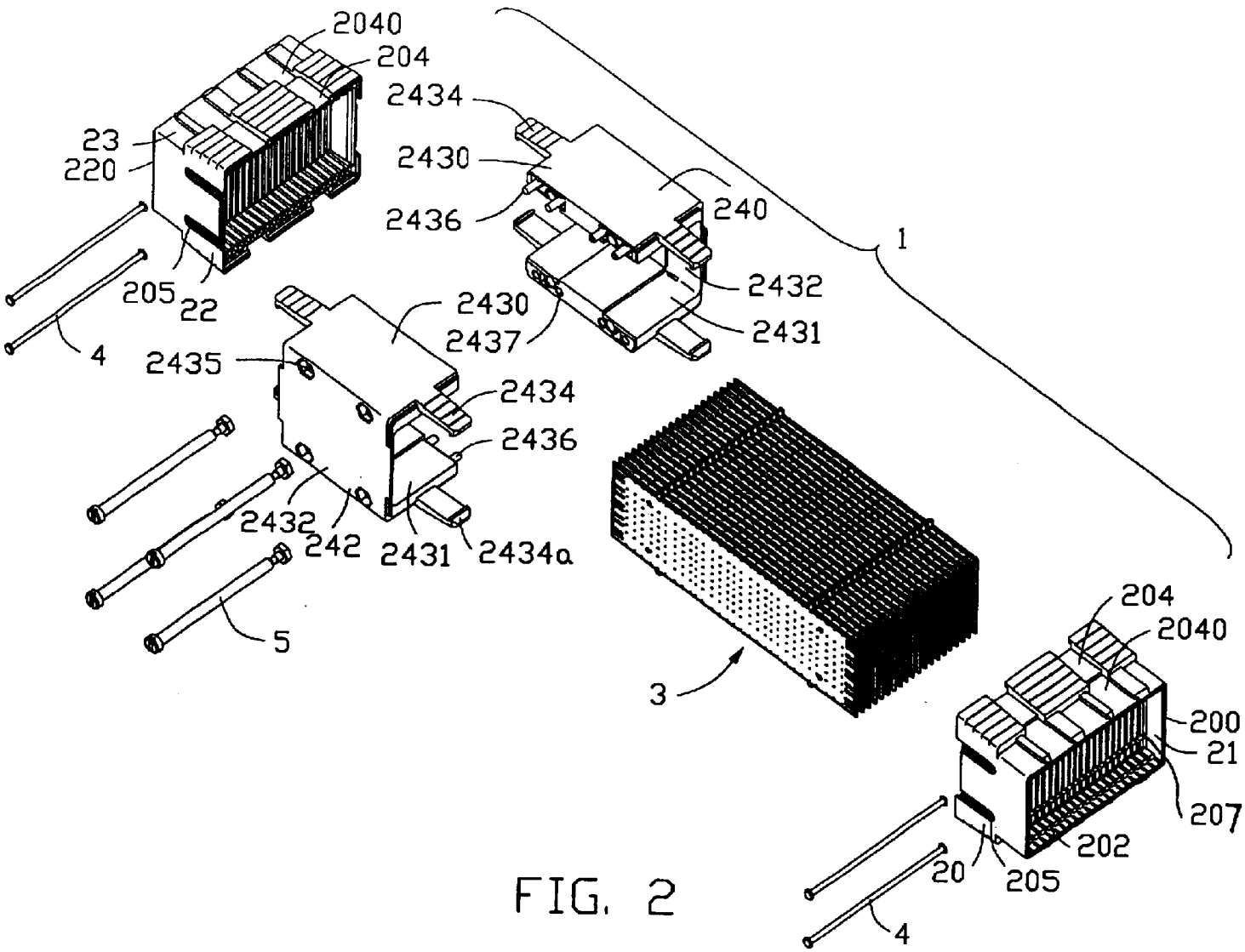
FIG. 2 is an exploded perspective view of the connector shown in FIG. 1.

Referring to FIG. 2 in conjunction with FIG. 1, the dielectric housing 2 comprises a front housing portion 20, a rear housing portion 22 and an intermediate housing portion 24 interconnecting the front housing portion 20 with the rear housing portion 22. The front and the rear housing portions 20, 22 are identical in structure and each are generally in a rectangular shape. The front and the rear housing portions 20, 22 have front and rear mating sections 21, 23 adjacent front and rear mating faces 200, 220 thereof, respectively. The front and the rear housing portions 20, 22 each define a plurality of juxtaposod channels 202 extending into the front and the rear mating sections 21, 23 along a front-to-back direction, and a plurality of notches 203 (FIG. 5) communicating with the corresponding channels 202. The front and the rear housing portions 20, 22 further define a plurality of recesses 204 in top and bottom faces, a plurality of cavities 2040 recessed inwardly from the corresponding recesses 204 and a plurality of apertures 205 extending through opposite side faces along a lateral direction substantially perpendicular to the extending direction of the channels 202. A plurality of transversely aligned notches 207 extend from the mating section 200, 220 toward the intermediate housing portion 24 (FIGS. 2 and 6).

The intermediate housing portion 24 comprises a split body having a first half 240 and a second half 242. Each half 240, 242 includes a top panel 2430, a bottom panel 2431 and a side panel 2432 formed between the top paneL 2430 and the bottom panel 2431. A plurality of latches 2434 extends forwardly and rearwardly from front and rear edges of the top and the bottom panels 2430, 2431. Each latch 2434 has a projection 2434*a* formed at a free end thereof. The first and the second halves 240, 242 define a plurality of bores 2435 in the top and the bottom panels 2430, 2431 penetrating through the side panels 2432. The first half 240 and the second half 242 have a plurality of dowel pins 2436 and corresponding holes 2437 for joining the first half 240 and the second half 242 together. It should be noted that any other suitable connecting means may be employed to connect the first and the second halves 240, 242. This split design of the intermediate portion 24 helps to facilitate connecting the front and the rear housing portions 20, 22. It can be understood that the intermediate housing portion 24 can also be made as a one-piece configuration.

Figure 3:
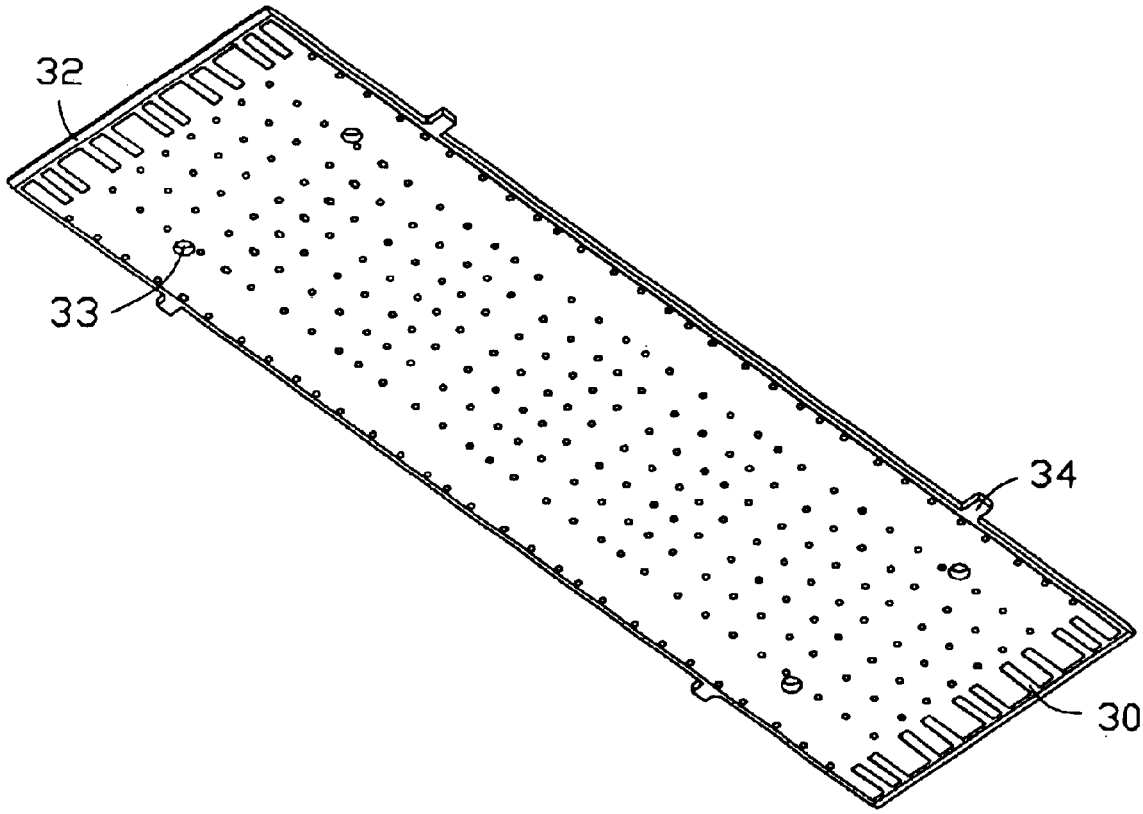
FIG. 3 is an enlarged perspective view of a circuit board of the connector.
Figure 4:
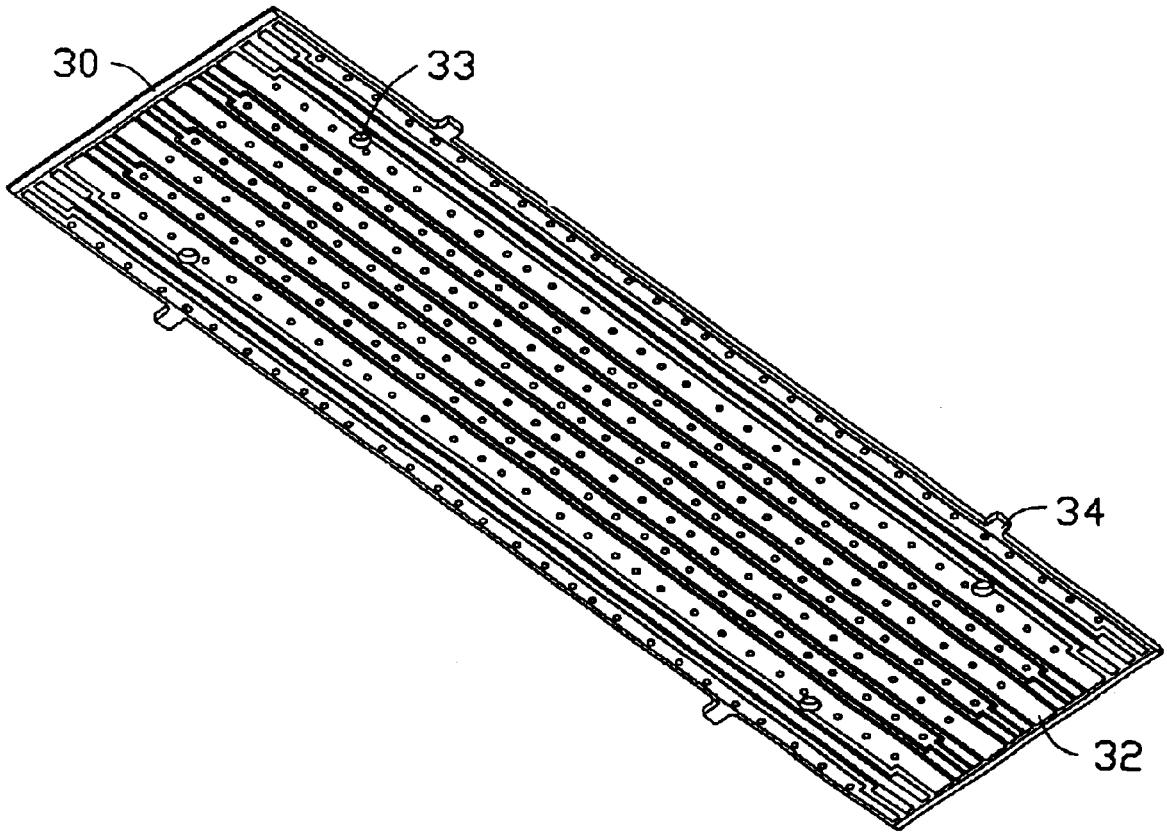
FIG. 4 is a view similar to FIG. 3 but taken from a different perspective.

Each one of the circuit boards 3 is identical in structure and an exemplary one thereof being shown in FIGS. 3 and 4. The circuit board 3 includes a dielectric substrate made of conventional circuit board substrate material, such as FR4, a plurality of conductive signal traces (not labeled) on one side of the substrate for providing electrical paths through the connector 1 and a plurality of grounding traces (not labeled) on both sides of the substrate for grounding purpose. The circuit board 3 comprises opposite front and rear mating edges 30, 32 respectively received in the channels 202 of the front and the rear mating sections 21, 23 of the housing 2. The circuit board 3 defines a plurality of through holes 33 transversely aligned with the corresponding apertures 205 and notches 207 of the front and the rear housing portions 20, 22. The circuit board 3 is formed with a plurality of protrusions 34 on top and bottom edges thereof.

Figure 5:
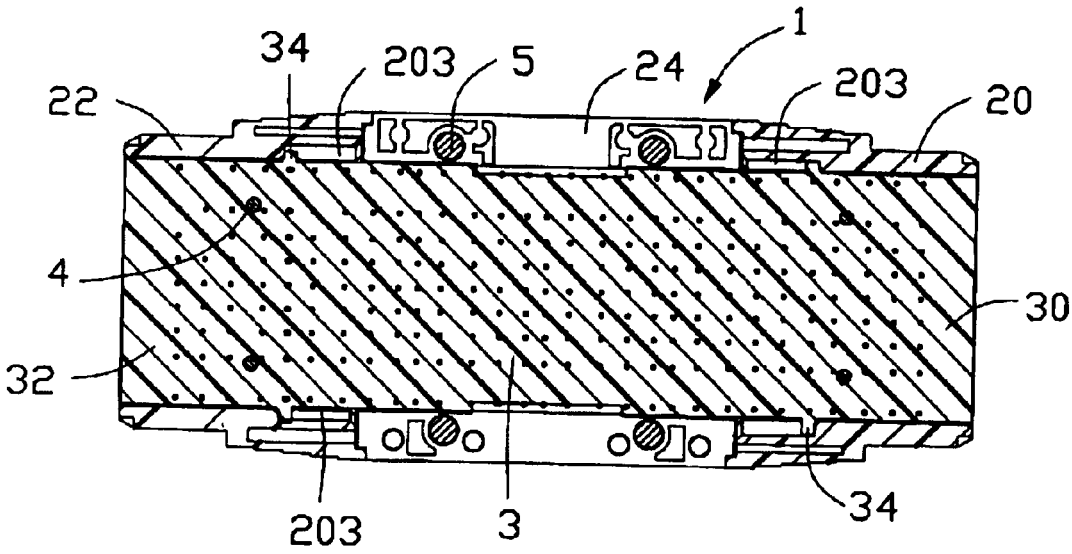
FIG. 5 is a first cross-section view of the connector shown in FIG. 1.
Figure 6:
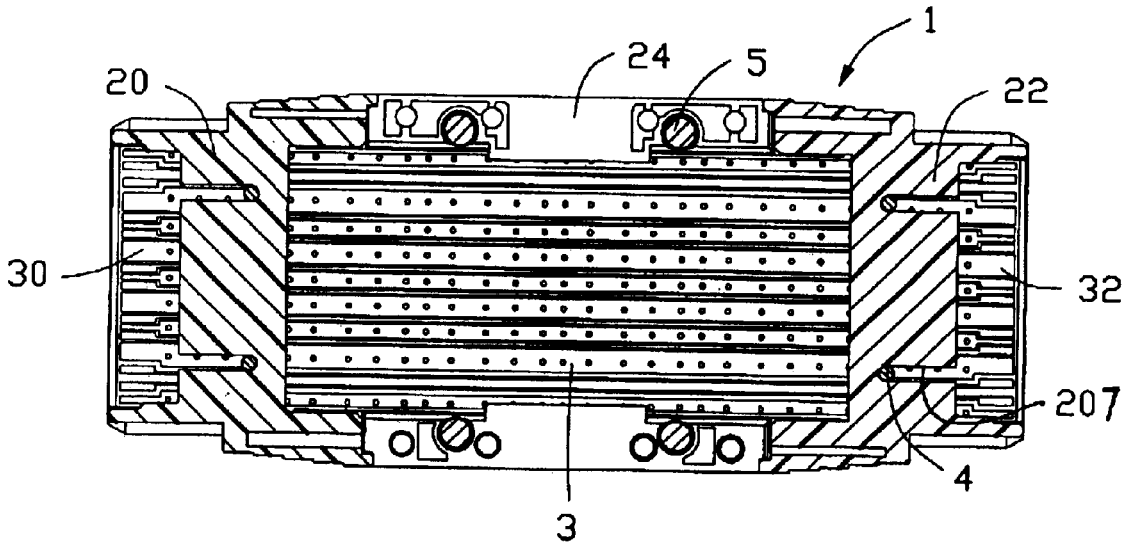
FIG. 6 is a second cross-section view of the connector shown in FIG. 1.
Figure 7:
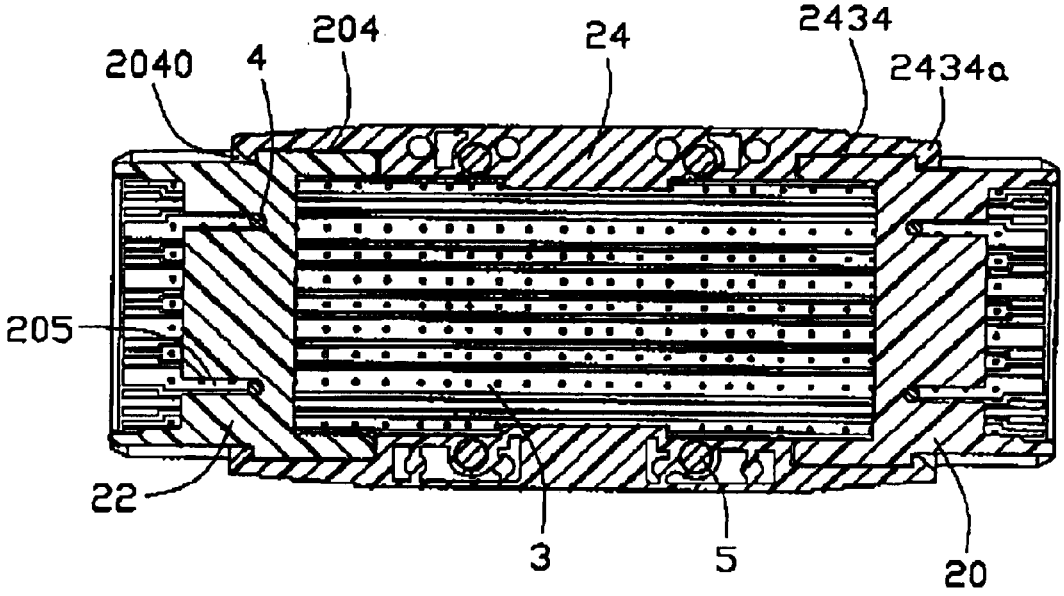
FIG. 7 is a third cross-section view of the connector shown in FIG. 1.

Referring to FIGS. 5–7 in conjunction with FIGS. 1–2, the circuit boards 3 are moved toward the front mating face 200 of the front housing portion 20 until the circuit boards 3 arrive at a position in which the protrusions 34 adjacent the front mating edges 30 abut against front ends of the notches 203 of the front housing portion 20. The front mating edges 30 of the circuit boards 3 are received in the channels 202 of the front housing portion 20. The first fastening elements 4 are inserted through the apertures 205 and the notches 207 of the front housing portion 20 and the through holes 33 adjacent the front edges 30 of the circuit boards 3. The first fastening elements 4 are further fastened to the front housing portion 20 for keeping the circuit boards 3 in the front housing portion 20.

The first and the second halves 240, 242 of the intermediate housing portion 24 are first assembled toward each other in the lateral direction by an interferential engagement between the dowel pins 2436 and the corresponding holes 2437, and then are successively commonly attached to the front housing portion 20 in the front-to-back direction with the projections 2434*a* of the latches 2434 mechanically engaging the cavities 2040 of the recesses 204 of the front housing portion 20 (FIG. 7). The second fastening elements 5 are inserted through the bores 2435 of the intermediate housing portion 24 to restrain movement of the circuit boards 3 in a vertical direction.

The rear mating edges 32 of the circuit boards 3 are exposed outside the front housing portion 20 and the intermediate housing portion 24 and are moved toward the rear mating face 220 of the rear housing portion 22 until the protrusions 34 adjacent the rear mating edges 32 abut against rear ends of the notches 203 of the rear housing portion 22. The rear mating edges 32 of the circuit boards 3 are received in the channels 202 of the rear housing portion 22. The projections 2434*a* of the latches 2434 mechanically engage the cavities 2040 of the recesses 204 of the rear housing portion 22 (FIG. 7). The first fastening elements 4 are inserted through the apertures 205 and notches 207 of the rear housing portion 22 and the through holes 33 adjacent the rear mating edges 32 of the circuit boards 3. The first fastening elements 4 are further fastened to the rear housing portion 22 for keeping the circuit boards 3 in the rear housing portion 22.

It is noted that the circuit board 3 has a larger length with the front and the rear mating edges 30, 32 respectively received in the front and the rear housing portions 20, 22 for simultaneously mating with two complementary connectors respectively mounted on first and second circuit substrates (not shown) to thereby establish an electrical connection therebetween. It can be understood that since the front and the rear housing portions 20, 22 are identical in structure and the circuit boards 3 have the front and the rear mating edges 30, 32 directly mating with the complementary connectors, whereby the manufacturing cost of the connector 1 is decreased. It is also noted that the dielectric housing 2 can be made as a one-piece configuration.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing comprising opposite first and second mating sections which are identical in structure; and a plurality of elongate circuit boards retained in the housing, each circuit board comprising first and second mating edges respectively received in the first and the second mating sections of the housing for mating with complementary components; wherein the housing defines a plurality of juxtaposed channels in the first and the second mating sections, the channels being arranged alone a first direction of the housing, and the circuit boards are side by side received in the channels, the circuit boards extending along a second direction perpendicular to the first direction.

2. The electrical connector as claimed in claim 1, wherein the housing defines a plurality of notches communicating with corresponding channels, and each circuit board comprises a plurality of projections received in the notches of the housing.

3. The electrical connector as claimed in claim 1, wherein the dielectric housing comprises front and rear housing portions respectively receiving therein the first and the second mating edges of the circuit boards.

4. The electrical connector as claimed in claim 3, wherein the front and the rear housing portions are identical in structure.

5. The electrical connector as claimed in claim 3, further comprising a first fastening element, and wherein the front and the rear housing portions define a plurality of apertures extending in the second direction, and the circuit boards define a plurality of through holes aligned with corresponding apertures, the first fastening element inserting through a corresponding aperture of the housing and corresponding through holes of the circuit boards.

6. The electrical connector as claimed in claim 3, wherein the housing comprises an intermediate housing portion interconnecting the front and the rear housing portions.

7. The electrical connector as claimed in claim 6, further comprising a second fastening element, and wherein the intermediate housing defines a bore extending in the second direction, the second fastening element inserting through the bore.

8. The electrical connector as claimed in claim 6, wherein the intermediate housing portion comprises first and second halves joined together intermediate housing portion comprises first and second halves joined together.

9. The electrical connector as claimed in claim 8, wherein each of the first and the second halves of the intermediate housing portion comprises a plurality of latches, and the front and the rear housing portions define a plurality of recesses fittingly receiving the latches.

10. An extender for use with electrical connection, comprising:

opposite front and rear housings spaced away from each other by an intermediate housing, each of said front and rear housings defining juxtaposed channels extending along a front-to-back direction; and a plurality of juxtaposed printed circuit boards positioned in said intermediate housing with opposite edge sections respectively inserted into the corresponding channels of said front and rear housings; wherein the intermediate housing comprises two halves assembled to each other along a transverse direction perpendicular to said front-to-back direction.

11. The extender as claimed in claim 10, wherein a fastening bar extending along said transverse direction, to combine the printed circuit boards and one of said front and rear housing.

12. The extender as claimed in claim 10, wherein said two halves are assembled to the corresponding front and rear housings in said front-to-back direction.

13. An electrical connection device, comprising:

an insulative first housing defining juxtaposed channels extending along a front-to-back direction;

an insulative second housing latchably forwardly assembled to a rear portion of the first housing and a plurality of juxtaposed printed circuit boards positioned in the second housing with front edge sections respectively extending into the first housing;

a plurality of notches formed in the first housing and aligned with one another in a transverse direction perpendicular to said front-to-back direction;

a plurality of holes formed in said printed circuit boards and aligned with one another in said transverse direction; and a fastening bar extending through all said notches and said holes, which are alternately arranged with one another, so as to retain the printed circuit boards in position relative to the first housing without movement along a vertical direction perpendicular to both said front-to-back direction and said transverse direction.

14. The connection device as claimed in claim 13, wherein said notches forwardly communicate with an exterior.

* * * * *